US005367963A

United States Patent [19]

Jäggi et al.

[11] Patent Number: 5,367,963

[45] Date of Patent: Nov. 29, 1994

[54] OFFICE TABLE

[75] Inventors: Heinz Jäggi; Bruno Marty, both of Rüti, Switzerland

[73] Assignee: Embru-Werke, Mantel & Cie., Switzerland

[21] Appl. No.: 955,284

[22] Filed: Oct. 1, 1992

[30] Foreign Application Priority Data

Oct. 1, 1991 [CH] Switzerland ..... 2896/91

[51] Int. Cl.[5] ..... A47B 9/00

[52] U.S. Cl. ..... 108/147; 108/10

[58] Field of Search ..... 108/147, 10, 5, 6, 144, 108/50; 248/188.4, 188.5

[56] References Cited

U.S. PATENT DOCUMENTS

| | | | |
|---|---|---|---|
| 1,293,246 | 2/1919 | Thompson | 108/5 X |
| 1,332,201 | 3/1920 | Borgarello | 108/10 |
| 3,908,565 | 10/1975 | Burnett | 108/147 |
| 4,441,432 | 4/1984 | Carlton | 108/5 |
| 4,568,071 | 2/1986 | Rice | 108/143 X |
| 5,172,641 | 12/1992 | Auer | 108/5 |

FOREIGN PATENT DOCUMENTS

| | | | |
|---|---|---|---|
| 3835717 | 4/1990 | Germany | 108/5 |
| 8801157 | 12/1989 | Netherlands | 108/5 |

*Primary Examiner*—Jose V. Chen

*Attorney, Agent, or Firm*—Dorn, McEachran, Jambor & Keating

[57] ABSTRACT

The table has two telescopable supports (4) each with a flange (22) at the upper end. To the flanges (22) there is screwed fast a tub (6). In the rear part of the tub (6) there is present a cable channel. The table plate (8) is horizontally shiftable on the tub, so that the cable channel is accessible. With an extensible crank (62) over a toothed-belt gear two threaded spindles are synchronously actuated in the supports (4) for the height adjustment. The table is rapidly resolvable into space-saving parts, without its being necessary for the height-adjusting mechanism to be disassembled. The table is convenient to operate.

20 Claims, 4 Drawing Sheets

29
II
14
12
10
IV
26
IV
98
62
8
6
III
78
2
29
4

8
36
90
30
34
76
74

26
16
72
24
22
28
26
16
6
32
64
62
78

2
4
6
8
10
12
14
16
18
20
22
24
26
29
40
62
64
82
84
86
87
88
89
90
92
94
96
98
100
104
106

OFFICE TABLE

DESCRIPTION OF THE PRIOR ART

An office table with a cable channel and an elevationally adjustable table plate is known from DE-PS030 16 369. This table has two side carriers, each with a horizontal foot, a column extending upward at its rear end and an arm extending forward at its upper end. These two columns are hollow and joined with one another at the top by a cable channel. Between the arms there is installed a table plate which is adjustable stepwise in height and slope. This table has proved successful. Its cable channel, to be sure, is undersized for today's requirements. The table has a relatively great transport volume, and the height adjustment is relatively complicated.

Underlying the present invention is the problem of obviating these disadvantages. This problem is solved by the feature combinations described in the claims.

In the following example, the invention is explained with the aid of the drawing.

DETAILED DESCRIPTION OF THE PREFERRED EMBODIMENT

Figure 1:
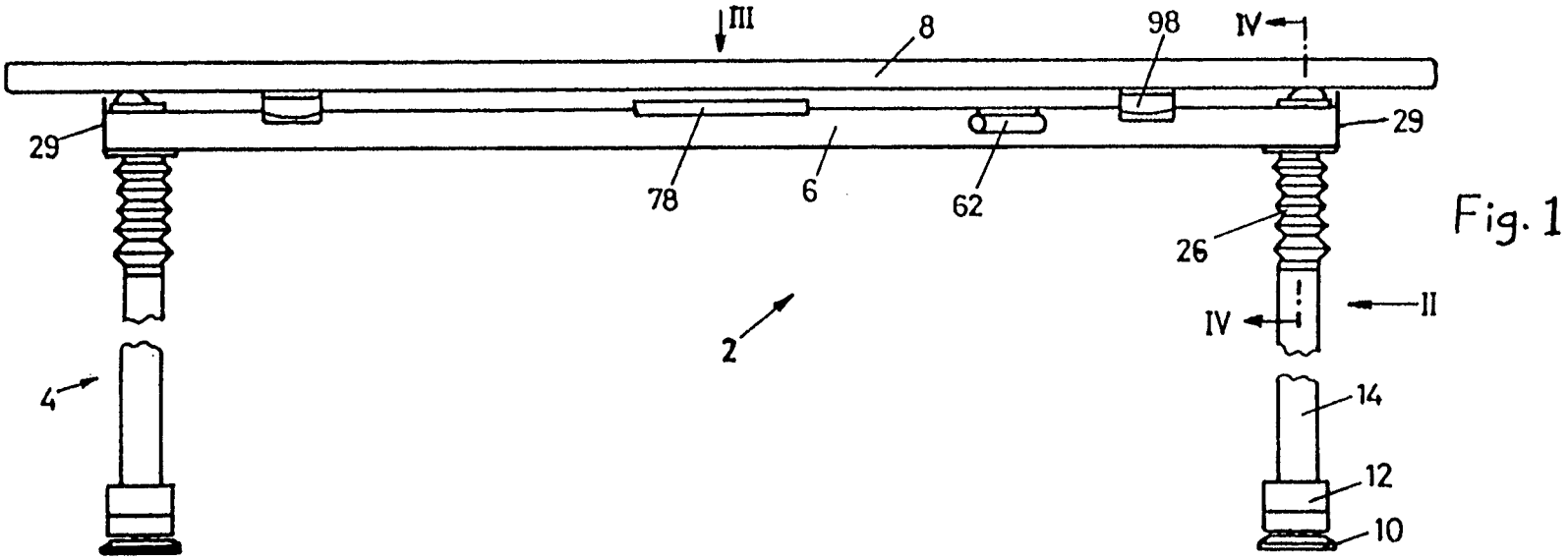
FIG. 1 shows a front view of a table, according to the present invention
Figure 4:
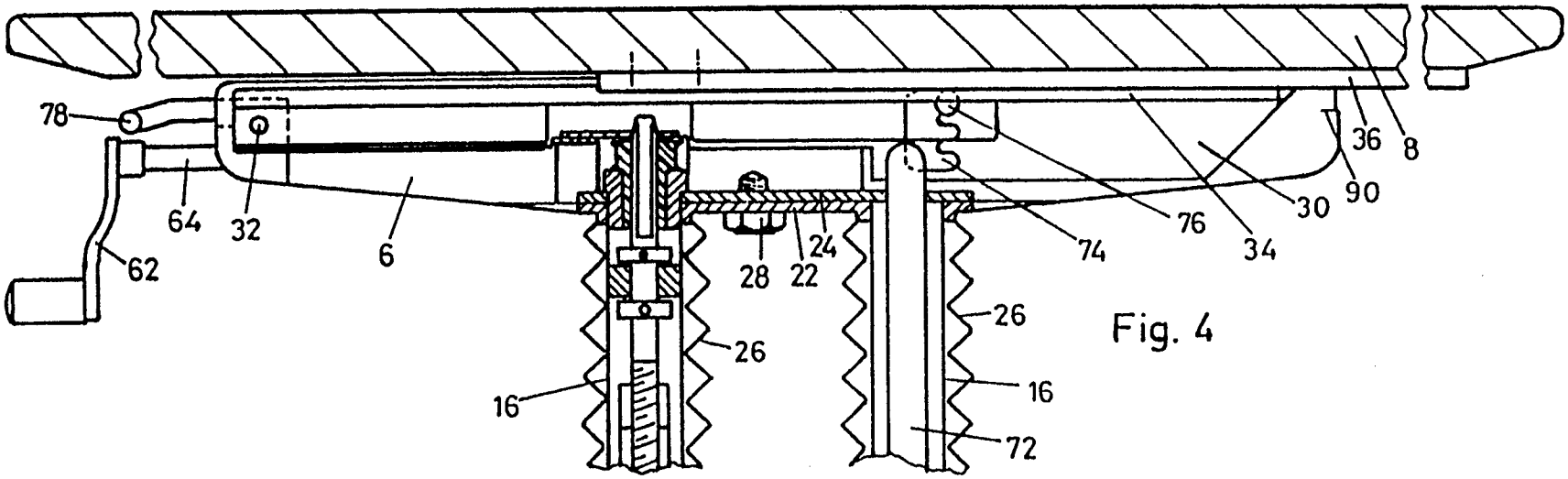
FIG. 4 illustrates in cross section the table according to the present invention taken approximately along the line IV—IV in FIG. 1.
Figures 2, 6:
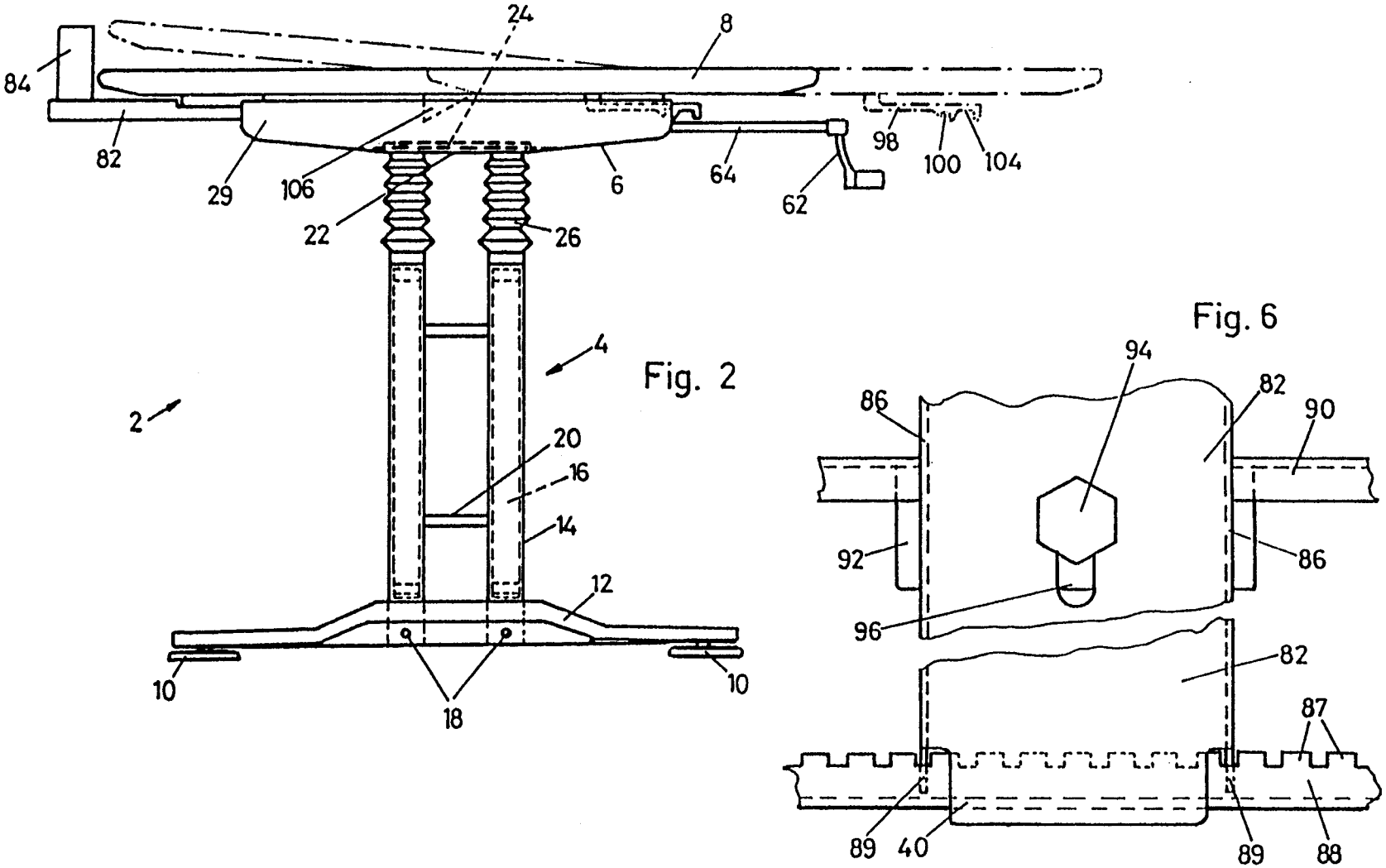
FIG. 2 illustrates in a cross-sectional side view taken in direction II in FIG. 1.
FIG. 6 shows an enlarged cut-out from the plan view according to FIG. 3.
Figure 3:
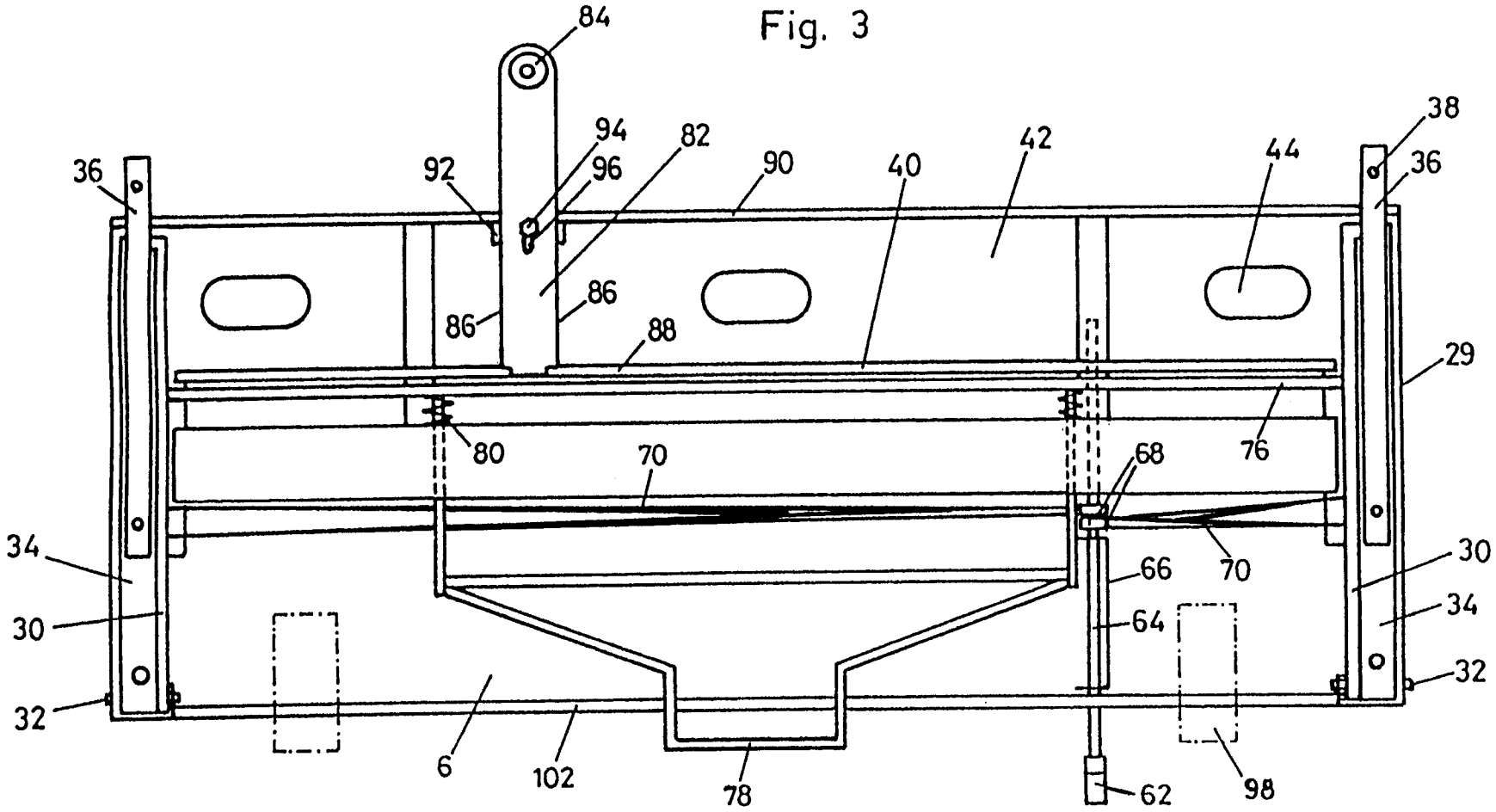
FIG. 3 shows a plan view of the table, with table leaf removed.
Figure 5:
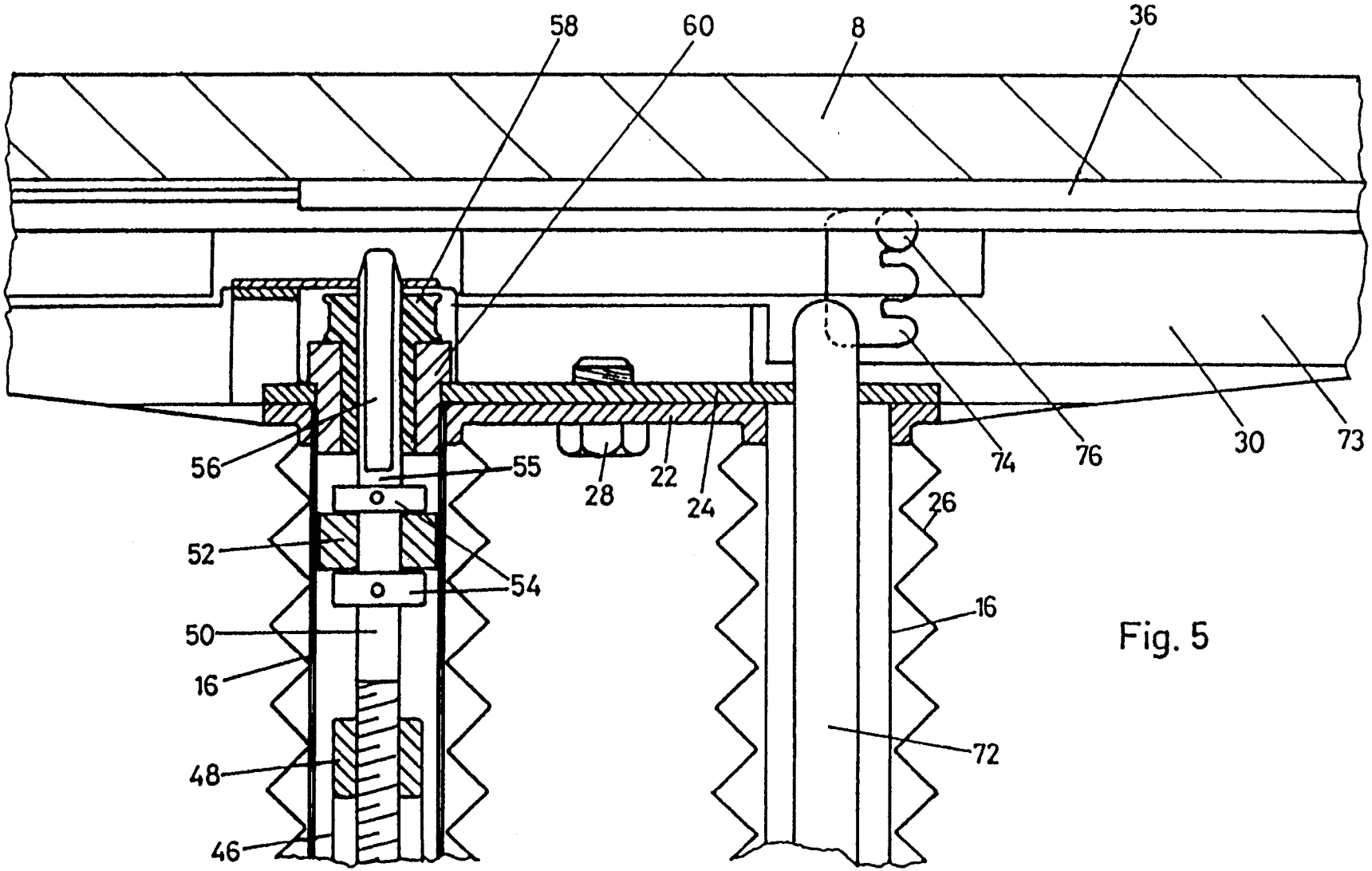
FIG. 5 shows an enlarged representation of a cut-out from FIG. 4.

The office table 2 consists of two supports 4, a tub 6 detachably joined with the two supports 4, and a table plate 8 slidably borne transversely to its longitudinal extent on the tub 6. Each support 4 has two feet 10 fastened to a horizontal carrier 12. In two vertical, cylindrical bores of the carrier 12 there are installed two pipes 14, in which two further pipes 16 are borne longitudinally slidably. The pipes 14 are fixed by pins 18 in the carrier 12 and joined with one another by transverse bars 20. The pipes 16 are welded above to a horizontal, flat flange 22. A flat plate 24 welded with the tub 6 rests on the flange 22 and is screwed with this by several screws 28. From the flange 22 there extends downward in each case a collar on which there is seated the upper end of a bellows 26. Its lower end is thrust onto the upper end of the pipe 14 concerned.

Adjacent to the front edge of the tub 6 and adjoining its two face walls 29 there is borne swingably in each case a pivot arm 30 swingable by means of a pin 32 on the tub 6. To each arm 30 there is screwed the one rail 34 of a ball-linear guide. The other rail 36 of the linear guide is screwed through bores 38 to the table plate 8. In the rear half of the tub 6, by a partition 40, a cable channel 42 is bounded with cable passage openings 44. In the pipe 14 facing the pivot axis 32 of the arm 30 there is fastened a coaxial, smaller pipe 46 by means of the pin 18. To the upper end of the pipe 46 there is welded a nut 48. Into the nut 48 there is screwed a threaded spindle 50. The spindle 50 is turnably borne in a bearing 52 fastened in the pipe 16 and secured against axial displacement relative to the bearing. Above the upper disk 54 the spindle 50 continues as shaft 55 with two diametrically oppositely lying flattenings 56. The shaft 55 projects over the flange 22 and is inserted through an axial opening of equal cross section of a gear wheel 58, which is turnably borne in a bearing 60 fastened to the plate 24 and is secured against axial displacement relative to the tub 6.

In a bearing plate 66 welded with the tub 6, a shaft 64 with non-round cross section is turnably and axially slidably borne. To the shaft 64 there is fastened in front a crank 62. On the shaft 64 there are seated two further gear ,wheels 68 with passage openings corresponding to the shaft cross section. They are secured against axial displacement relative to the tub 6. A toothed belt 70 in each case wraps around one of the gear wheels 68 and one of the gear wheels 58. Therewith both gear wheels 58 are joined torsion-firmly with one another and with the crank 62.

In the rear pipe pair 14, 16 there is installed a gas pressure spring 72, one member of which is fastened by means of the pin 18 in the pipe 14, and the other member of which projects over the flange 22 and lies with bias tension on the arm 30. In a vertical plate 73 of the arm 30 there is cut out a chamber-type coulisse 74. Into one of the three side branches of the coulisse 74 there engages a rod 76 which extends between the two arms 30 and is joined with a bow 78 projecting beyond the front edge of the tube 6. The rod 76 is preloaded by springs 80 to the rear for engagement into one of the side branches of the coulisse 74. By pulling on the bow 78 the slope of the table plate 8 can be adjusted.

To the rear edge of the tube 6 there is fastened a carrier 82 with a pipe 84 for the reception of a bracket, for example for a picture screen. The carrier 82 is a U-plate and lies in front on an angle-bend 88 of the partition 40. This has along its rearward-directed edge a rectangular gearing 87. The side walls 86 grip into tooth gaps of this gearing 87 and grip under the angle-bend 88 with in each case a projection 89. Therewith the front end of the carrier 82 is held on the partition 40 form-locking against movement toward the side and upward and downward. The side walls 86* lie at the rear edge of the tub 6 on an angle-bend 90. The carrier 82 is clamped fast to this angle-bend 90 by means of a screw 94 inserted through an oblong hole 96 of the carrier 82, screwed into a plate 92 gripping under the angle-bend 90.

To the underside of the table plate 8 there are fastened in front two elastic rest levers 98, which engage in the basic position with a notch 100 into a front angle-bend 102 of the tube 6. By means of a grip 104 the rest levers 98 can be lifted and the table plate 8 drawn forward for the freeing of the cable channel 42. In the extended position a wedge 106 fastened to the underside of the plate 8 snaps in place in front of the angle-bend 102, so that the table plate, only after a slight lifting, can be slid back into the basic position.

By the construction described table 2 very easily can be resolved into three individual parts by loosening of the screws 28 and lifting of the table plate 8 with the tub 6, without its being necessary to disassemble components of the height-adjustment gear, so that it can be transported and stored in a space-saving manner. Since the two supports 4 are identical, and therefore it is not necessary to produce a "right" and a "left execution", the manufacturing and keeping in stock are simplified. The gas pressure spring 72 supports both the raising and also the sloping of the table plate 8, so that in the height adjustment and the sloping only slight forces are required. The gear wheels 58, 68 set off at 90 degrees from one another with the toothed belt 70 yield a cost-favorable angle gear. The twisting of these toothed belts 70 is possible in this special case because the belts are narrow in relation to their length. For the height adjustment the crank 62 is drawn forward to a position in front of the front edge of the table plate 8, so that it is convenient to operate. After completion of the height adjustment the crank 62 is pushed back again in horizontal position (FIG. 1) onto the tub 6, so that it is not in the way and does not have to be disassembled and cared for. The cable channel 42 is very spacious and well accessible. Thereby there is yielded a simple cable laying. Although the carrier 82 for brackets is fixed only with a single clamping screw 94, its position is held surely by the form-locked engagement into the gearing 87, so that a jarring against the carrier 82 cannot twist this. By the wedge 106 it is achieved that with cable channel 42 open the table plate 8 cannot inadvertently be jolted to the rear while, for example, someone is doing manipulations on plug connections in the cable channel 42.

In the event that the height adjustment is not required, the pipes 14 are correspondingly lengthened and welded directly with the flange 22. The pipes 16 and bellows 26 as well as the height-adjustment gear are omitted. If also the slope adjustment is not required, the rails 34 are screwed directly to the tub 6 and the swinging arms 30 with the rest members as well as the gas pressure springs 72 are omitted.

We claim:

1. Office table comprising:

two vertical supports (4) constructed as hollow bodies, each support having two feet (10) at a lower end and at least one fastening flange (22) at an upper end;

a tub (6) having two face sides, a forward zone and a rear zone and fastened detachably to the at least one flange (22), in which tub in the rear zone by a longitudinally running partition (40) there is formed a cable channel (42) which presents at least one downwardly facing cable passage opening (44);

two linear guide elements (34) fastened adjacently to the two face sides (29) of the tub (6); and a table plate (8) being slidably connected to said linear guide elements thereby enabling the table plate to be slidably guided in a direction transverse to the partition (40) and having a basic position and an extended position, which plate in its basic position covers the tub (6) and in its extended position frees at least the rear zone of the tub containing the cable channel (42).

2. Office table according to claim 1, in which the supports (4) are telescopable and at least one gear wheel (58, 68, 70) is present for each support to provide for the synchronous raising and lowering of said at least one flange (22) relative to the feet (10).

3. Office table according to claim 2, in which each support (4) comprises a first pipe (14) joined with the feet (10) and a second pipe (16) conducted along the first pipe (14), joined with said at least one flange (22), in which system within these two pipes (14, 16) there is arranged a two-membered lifting element (48, 50) consisting of a threaded spindle (50) and a nut (48), a first member (48) of said lifting element (48,50) being fastened to the first pipe and a second member (50) of said lifting element (48,50) being rotatably but axially fixedly supported on said second pipe (16), wherein a shaft (55) with an unround cross section extends from said second member (50) and projects above said flange (22), said shaft (55) being received in a central opening of equal cross section in a gear wheel (58) which is rotatably but axially fixedly supported in said tub (6), and wherein the two gear wheels (58) assigned one each to the two supports (4) include means to provide slip free interconnection with one another and with a crank (62).

4. Office table according to claim 3, in which the crank (62) presents a shaft (64) with non-round cross section arranged horizontally transversely to the partition (40), borne turnably and longitudinally shiftably in the tub (6), on which shaft there are seated two further gear wheels (68) with further openings corresponding to the shaft cross section, and in which the further gear wheels (68) are secured against axial displacement relative to the tub (6) and are each joined with the first gear wheels (58) through the interconnection means comprising at least one toothed belt (70) each.

5. Office table according to claim 4, in which there is present additionally a spring member (72) the lower end of which is connected with the feet (10) and the upper end of which overhangs the flange (22) and lies with bias tension on a component (30) connected with the table plate (8).

6. Office table according to claim 5, in which each support (4) additionally comprises a third pipe (14) joined with the feet (10) and a fourth pipe (16) joined with the flange (22), guided longitudinally slidable on the third pipe (14), and in which the spring member (72) is arranged inside the third and fourth pipes (14, 16).

7. Office table according to claim 1, in which adjacently to the two face sides (29) of the tub (6) adjacently to its front edge there is borne in each case a swinging arm (30) swingable on the tub (6), which bears the respective linear guide element (34) and in which each swinging arm (30) presents, spaced from its pivot axis (32), in each case a rest element (74) for the adjustment of the table inclination and the two rest elements (74) cooperate with in each case a rest member (76) movable in the tub (6) and the two rest members (76) are actuatable in common.

8. Office table according to claim 1 in which the partition (40) has at the top a toothed first angle-bend (88) and a rear wall of the tub (6) has at the top a second angle-bend (90), in which arrangement a carrier (82) for a bracket rests on the two angle-bends (88,90), is joined by a clamping member (92,94) with the second angle-bend (90), which together with an engagement member (89), grip into the gearing (87) of the first angle-bend (88) and grip under this first angle-bend (88).

9. Office table according to claim 1, in which to the table plate (8) there is fastened a releasable rest member (98) which snaps in place in the basic position of the table plate (8).

10. Office table according to claim 9, in which to the table plate (8) there is fastened a second, releasable rest member (106) which snaps in place in the extended position of the table plate (8).

11. An office table comprising (a) two vertical supports, each having a hollow core, an upper end and a lower end, the lower end of each support having two feet and the upper end of each support having at least one fastening flange;

(b) a tub disposed adjacent the upper ends of said supports, said tub having two lateral sides, a forward zone and a rear zone, the rear zone being separated by a longitudinally running partition, the tub rear zone defining a cable channel having at least one downwardly facing cable passage opening;

(c) two linear guide elements fastened one each to the two lateral sides of said tub; and (d) a table plate being slidably connected to said linear guide elements, and resting over said tub to provide a cover thereover thereby defining a table plate basic position, whereby said guide elements permit slidable motion of the table plate in a direction transverse to the partition, so that the table plate may be slidably moved from the basic position to an extended position.

12. An office table according to claim 11 wherein said vertical supports are telescopable and further comprise a gear, having a first gear wheel, for synchronous raising and lowering of said at least one flange and said support upper ends relative to said feet.

13. An office table according to claim 12 wherein each support further comprises a first pipe being joined at said feet and a second pipe concentrically fitting within said first pipe and being joined to said at least one flange, the two pipes operating with a threaded spindle and a nut to provide a two-membered lifting element.

14. An office table according to claim 13 further comprising a shaft having a non-round cross-section being axially slidably borne within a bearing plate welded to said tub, said non-round shaft extending horizontally through said tub transverse to said tub partition and being rotationally and longitudinally movable within said tub, said shaft further comprising two shaft gear wheels which are fixed within said tub and axially slidable over the shaft and being joined to said first gear wheels by a toothed belt engaging both said first gear wheels and said shaft gear wheels, whereby rotation of said non-round shaft rotates said shaft gear wheels and said first gear wheel to lower and raise said table plate and said at least one flange relative to said support feet.

15. An office table according to claim 14 further comprising a spring member connected at one of its ends to the feet and at its other end overhanging said flange and providing a bias tension to said table plate through a connection to an arm connected to the table plate.

16. An office table according to claim 15 further comprising a third pipe being joined to said feet and a fourth pipe joined with said flange, said fourth pipe being longitudinally slidable relative to and disposed within said third pipe, said spring member extending through said third and fourth pipes.

17. An office table according to claim 11 further comprising two swinging arms, one each being disposed adjacent to one of said two lateral sides, one end of each arm being vertically swingable within said tub about a pivot axis, the pivot axis of one said arm being coextensive with said pivot axis of said other arm, said pivot axes being essentially parallel to said partition, and one each of said linear guide elements being disposed on each of said arms, each said arm further having a rest element, each said rest element on each said arm cooperating with a rest member movable in common in said tub to provide adjustment of the table inclination.

18. An office table according to claim 11, said partition further comprising at a top portion thereof a first angle-bend having a toothed gearing, and a rear wall of said tub having a second angle-bend at a top portion thereof, the tub further comprising a carrier for a bracket resting on said two angle-bends, said carrier operating with a clamping member on said second angle-bend and with an engagement member to grip into the toothed gearing of said first angle-bend and to grip under the first angle-bend.

19. An office table according to claim 11 comprising a releasable rest member fastened on said table plate which snaps in place to retain said table plate in said basic position.

20. An office table in accordance with claim 19 further comprising a second releasable rest member which snaps in place to retain said table plate in said extended position.

* * * * *